US010675868B2

(12) United States Patent
Nonoyama et al.

(10) Patent No.: US 10,675,868 B2
(45) Date of Patent: Jun. 9, 2020

(54) LIQUID DISCHARGING DEVICE AND DRIVE WAVEFORM CONTROL METHOD

(71) Applicants: Yusuke Nonoyama, Kanagawa (JP); Yoshiyuki Ishiyama, Kanagawa (JP); Masanori Hirano, Kanagawa (JP); Shinichi Hatanaka, Tokyo (JP)

(72) Inventors: Yusuke Nonoyama, Kanagawa (JP); Yoshiyuki Ishiyama, Kanagawa (JP); Masanori Hirano, Kanagawa (JP); Shinichi Hatanaka, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/354,828

(22) Filed: Mar. 15, 2019

(65) Prior Publication Data

US 2019/0283412 A1 Sep. 19, 2019

(30) Foreign Application Priority Data

Mar. 19, 2018 (JP) ..... 2018-051831
Jan. 24, 2019 (JP) ..... 2019-010686
Mar. 15, 2019 (JP) ..... 2019-048117

(51) Int. Cl.
*B41J 2/045* (2006.01)

(52) U.S. Cl.
CPC ..... *B41J 2/04588* (2013.01); *B41J 2/04508* (2013.01); *B41J 2/04541* (2013.01);
(Continued)

(58) Field of Classification Search
CPC ..... B41J 2/04588; B41J 2/04581; B41J 2/04563; B41J 2/04553; B41J 2/04541
(Continued)

(56) References Cited

U.S. PATENT DOCUMENTS 8,070,248 B2 * 12/2011 Ogama ..... B41J 2/04508 347/14
8,851,615 B2 * 10/2014 Ozawa ..... B41J 2/04563 347/10

(Continued)

FOREIGN PATENT DOCUMENTS

JP 2887012 2/1999
JP 2004-106253 4/2004
JP 2011-131429 7/2011

*Primary Examiner* — An H Do
(74) *Attorney, Agent, or Firm* — Harness, Dickey & Pierce, P.L.C.

(57) ABSTRACT

A liquid discharging device includes: a recording head that has nozzles discharging liquid, and forms an image on a target surface with the liquid while performing scanning of the target surface for multiple times; a moving unit that moves the recording head in main-scanning direction while making the head discharge liquid, and moves the head in sub-scanning direction after the head has discharged liquid; a drive waveform applying unit that applies a drive waveform to the respective nozzles; a temperature detecting unit that detects temperature about the head; a correcting unit that corrects drive waveform based on detected temperature; and a control unit that, when temperature about the head changes from first temperature to second temperature, performs control in such a way that, during the multiple scans, use of second-type drive waveform corresponding to the second temperature gradually increases against use of first-type drive waveform corresponding to the first temperature.

8 Claims, 12 Drawing Sheets

(52) U.S. Cl.
CPC ..... *B41J 2/04553* (2013.01); *B41J 2/04563* (2013.01); *B41J 2/04581* (2013.01)

(58) Field of Classification Search
USPC ..... 347/9–11, 17, 19
See application file for complete search history.

(56) References Cited

U.S. PATENT DOCUMENTS

| | | | | |
|---|---|---|---|---|
| 10,083,380 | B2 | 9/2018 | Hirano et al. | |
| 2001/0040595 | A1* | 11/2001 | Taki | B41J 2/04541 347/9 |

* cited by examiner

LIQUID DISCHARGING DEVICE AND DRIVE WAVEFORM CONTROL METHOD

CROSS-REFERENCE TO RELATED APPLICATIONS

The present application claims priority under 35 U.S.C. § 119 to Japanese Patent Application No. 2018-51831, filed on Mar. 19, 2018, Japanese Patent Application No. 2019-010686, filed on Jan. 24, 2019, and Japanese Patent Application No. 2019-048117, filed on Mar. 15, 2019. The contents of which are incorporated herein by reference in their entirety.

BACKGROUND OF THE INVENTION

1. Field of the Invention

The present invention relates to a liquid discharging device and a drive waveform control method.

2. Description of the Related Art

Conventionally, as a liquid discharging device, an Inkjet recording device is known in which drive waveforms are applied to piezoelectric elements, and the resultant deformation in the piezoelectric elements is used to regulate the pressure inside an ink chamber to a higher level or a lower level; and accordingly ink droplets in the liquid form are discharged toward the target object such as a paper sheet.

In such an inkjet recording device, since the viscosity of the discharged ink changes due to the ambient temperature, there is a known technology for detecting the temperature using a thermistor installed at a predetermined position in the inkjet recording device and outputting drive waveforms corresponding to the ink viscosity that is expected at the detected temperature.

Moreover, in order to achieve a high image quality by holding down the variation in the image quality attributed to the changes in temperature, a drive waveform control method has been disclosed in which the optimum discharging speed is maintained by varying the drive waveforms according to the change in temperature of the ink.

However, in the conventional drive waveform control method, the drive waveforms are switched in a discontinuous manner at predetermined temperature intervals, whereas the change in temperature of the ink occurs in a continuous manner. Hence, the volume of the discharged ink corresponding to the pre-switching drive waveforms and the volume of the discharged ink corresponding to the post-switching drive waveforms undergo a relatively large variation, thereby causing unevenesss in the density of the printed images. Moreover, generally the inkjet head has variation in the discharging characteristics (such as variation in the resonance periods of individual liquid chambers) that is attributed to the variation during manufacturing. Depending on the extent of variation, there are times when the unevenness in the density becomes conspicuous. Particularly, in a serial printer in which a paper sheet is scanned by the head, unevenness in the density occurs in a stepped manner thereby resulting in a decline in the image quality.

SUMMARY OF THE INVENTION

According to an embodiment, a liquid discharging device includes a recording head, a moving unit, a drive waveform applying unit, a temperature detecting unit, a correcting unit, and a control unit. The recording head has a plurality of nozzles for discharging liquid, and forms an image on a discharge target surface by discharging liquid onto the discharge target surface while performing scanning of the discharging target surface for a plurality of times. The moving unit moves the recording head in main-scanning direction while making the recording head discharge liquid, and moves the recording head in sub-scanning direction after the recording head has discharged liquid. The drive waveform applying unit applies a drive waveform to each of the plurality of nozzles. The temperature detecting unit detects temperature in vicinity of the recording head. The correcting unit corrects drive waveform based on temperature detected by the temperature detecting unit. The control unit performs, when temperature in vicinity of the recording head changes from first temperature to second temperature, control in such a way that, during the scanning for a plurality of times, use of second-type drive waveform corresponding to the second temperature gradually increases against use of first-type drive waveform corresponding to the first temperature.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
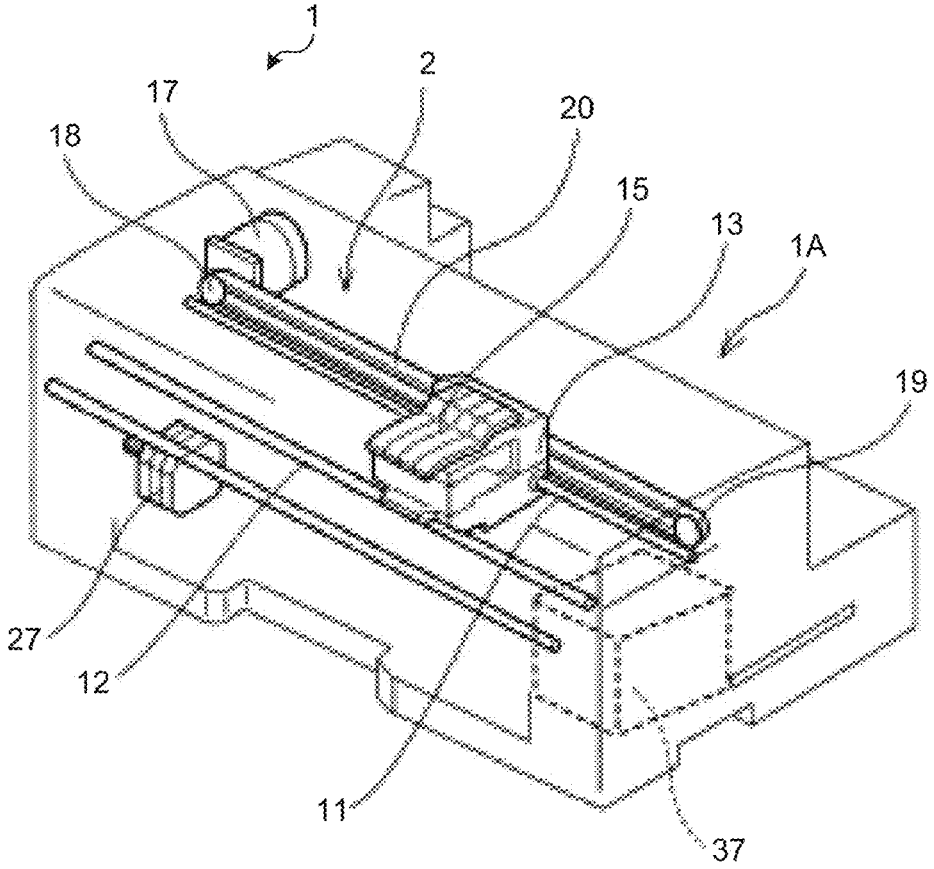
FIG. 1 is an external perspective view of an inkjet recording device, which represents an example of a liquid discharging device according to embodiments, with its configuration illustrated in perspective.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Figure 2:
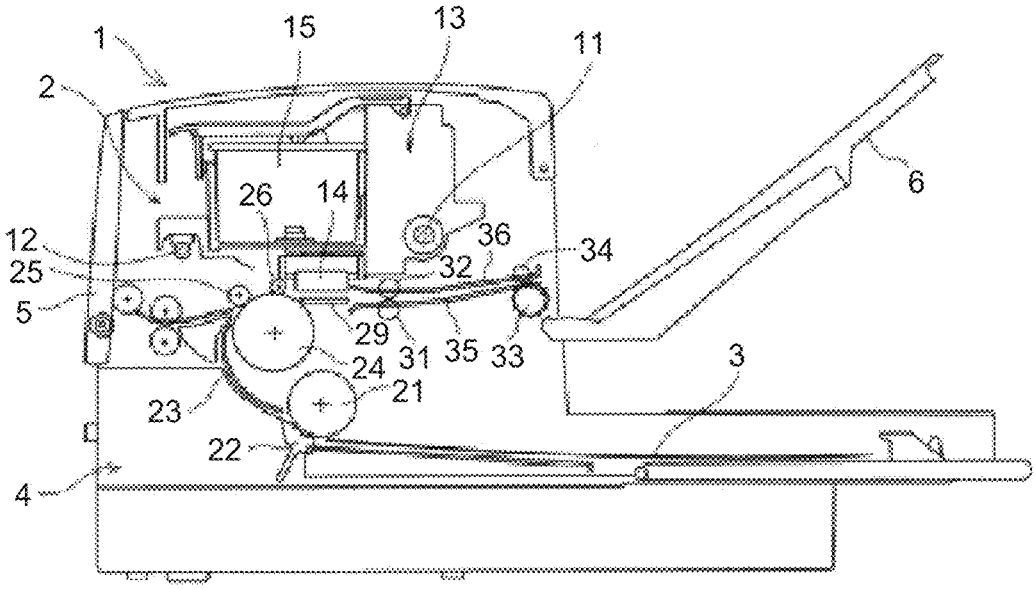
FIG. 2 is a lateral view for explaining the internal mechanism of the Inkjet recording device.

Exemplary embodiments of a liquid discharging device and a drive waveform control method according to the present invention are described below in detail with reference to the accompanying drawings. Explained below with reference to FIGS. 1 and 2 is an exemplary inkjet recording device representing an example of the liquid discharging device according to the embodiments. FIG. 1 is a perspective view of the inkjet recording device with its internal mechanism illustrated in perspective. FIG. 2 is a lateral view for explaining the internal mechanism of the inkjet recording device.

In an inkjet recording device 1, a printing mechanism 2 is housed that is configured using: a carriage which is movable along the main-scanning direction inside a recording device main body 1A; recording heads made of inkjet heads which are mounted on the carriage; and ink cartridges which provide inks to the recording heads. In the lower part of the recording device main body 1A, it is possible to detachably attach a sheet feeding cassette 4 in which a plurality of paper sheets 3 can be placed from the front side. Moreover, a sheet feeding tray 5 that is meant for manually feeding the paper sheets 3 is attached in an openable-closable manner. Each paper sheet 3 that is fed either from the sheet feeding cassette 4 or from the sheet feeding tray 5 is incorporated in the recording device main body 1A and is subjected to recording of necessary images in the printing mechanism 2, and is then ejected to a paper ejection tray 6 that is mounted on the rear face side of the recording device main body 1A.

In the printing mechanism 2, a carriage 13 is held to be slidable along the main-scanning direction by a main guiding rod 11 and a subordinate guiding rod 12, which are guiding members laterally-bridged to the side panels (not illustrated) on the right and left sides. To the carriage 13 are fixed recording heads 14 each of which discharges ink droplets of one of yellow (Y), cyan (C), magenta (M), and black (Bk) colors. In each recording head 14, a plurality of ink discharge outlets (nozzles) is arranged in the direction of intersection with the main-scanning direction. Moreover, the recording heads 14 are fixed in such a way that the ink droplets are discharged downward. Meanwhile, in the carriage 13, ink cartridges 15 are fixed in a replaceable manner for the purpose of providing the inks of the abovementioned four colors to the recording heads 14.

The ink cartridges 15 have an air communicating vent formed in the upper portion, have a supply port formed in the lower portion for supplying inks to the recording heads 14, and have a porous body filled with an ink housed therein. The inks that are housed in the ink cartridges 15 and that are supplied to the recording heads 14 are maintained at a moderate negative pressure due to the capillary force of the porous body. Meanwhile, herein, although a plurality of recording heads 14 corresponding to different colors is used, it is alternatively possible to use a single recording head having a plurality of nozzles for discharging ink droplets of different colors.

Regarding the carriage 13, the rear side thereof (the downstream side in the sheet conveyance direction) is slidably fit in the main guiding rod 11, and the front side thereof (the upstream side in the sheet conveyance direction) is slidably mounted on the subordinate guiding rod 12. In order to move the carriage 13 along the main-scanning direction for scanning purposes, a timing belt 20 is extended in between a driving pulley 18, which is rotary-driven using a main-scanning motor 17, and a driven pulley 10; and is fixed to the carriage 13. As a result, the carriage 13 is driven back and forth due to the forward and reverse rotation of the main-scanning motor 17.

In order to convey the paper sheet 3, which is set in the sheet feeding cassette 4, on the underside of the recording heads 14, following components are installed: a sheet feeding roller 21 and a friction pad 22 that are meant for separating the paper sheet 3 from the sheet feeding cassette 4 and then feeding the paper sheet 3; a guiding member 23 that is meant for guiding the paper sheet 3; a conveyance roller 24 that is meant for inverting the paper sheet 3 fed thereto and then conveying the paper sheet 3; a conveyance roller 25 that is pressed against the periphery of the conveyance roller 24; and a tip end roller 26 that defines the delivery angle of the paper sheet 3 with respect to the conveyance roller 24. The conveyance roller 24 is rotary-driven by a sub-scanning motor 49 (see FIG. 2) via a gear train 27.

Moreover, a print receiving member 29 is installed that represents a paper sheet guiding member for guiding the paper sheet 3, which is delivered from the conveyance roller 24 according to the range of movement of the carriage 13 along the main-scanning direction, on the underside of the recording heads 14. On the downstream side in the paper sheet conveyance direction of the print receiving member 29, a conveyance roller 31 and a spur 32 are installed that are rotary-driven for delivering the paper sheet 3 in the paper ejection direction; and a paper ejection roller 33, a spur 34, and guiding members 35 and 36 constituting the paper ejection path are also installed.

During a recording operation, the recording heads 14 are driven according to image signals while moving the carriage 13. As a result, the inks are discharged onto the paper sheet 3 that is stationary, and a single line gets recorded. Then, the paper sheet 3 is conveyed for a predetermined distance, and the next line is recorded. When a recording end signal is received or when a signal indicating that the rear end of the paper sheet 3 has reached the recording area, the recording operations is ended and the paper sheet 3 is ejected.

Meanwhile, at a position that is away from the recording area on the right side of the direction of movement of the carriage 13, a recovery device 37 is disposed for enabling recovery of defective discharging from the recording heads 14. The recovery device 37 includes a capping unit, a suction unit, and a cleaning unit. In the print standby state, the carriage 13 is moved to the side of the recovery device 37. Then, the recording heads 14 are capped by the capping unit. As a result of the capping, the discharge outlets of the recording heads 14 are maintained in a wet condition, thereby preventing defective discharging from the recording heads 14 attributed to drying of the inks. Moreover, during a recording operation, from the discharge outlets of the recording heads 14, the recovery device 37 sucks out the inks not related to the recording, so that the ink viscosity at all discharge outlets is maintained at a constant level and a stable discharging performance is achieved.

When there occurs defective liquid discharge, the discharge outlets (nozzles) of the recording heads 14 are sealed using the capping unit; the inks and air bubbles are sucked out via a tube using the suction unit; and ink and dirt attached to the discharge outlets is removed using the cleaning unit. With that, recovery of the defective discharging from the recording heads 14 can be achieved. The sucked-out inks are then ejected to a waste ink pool disposed in the lower portion of the main body, and are sucked and held in an ink absorber provided inside the waste ink pool.

Figure 3:
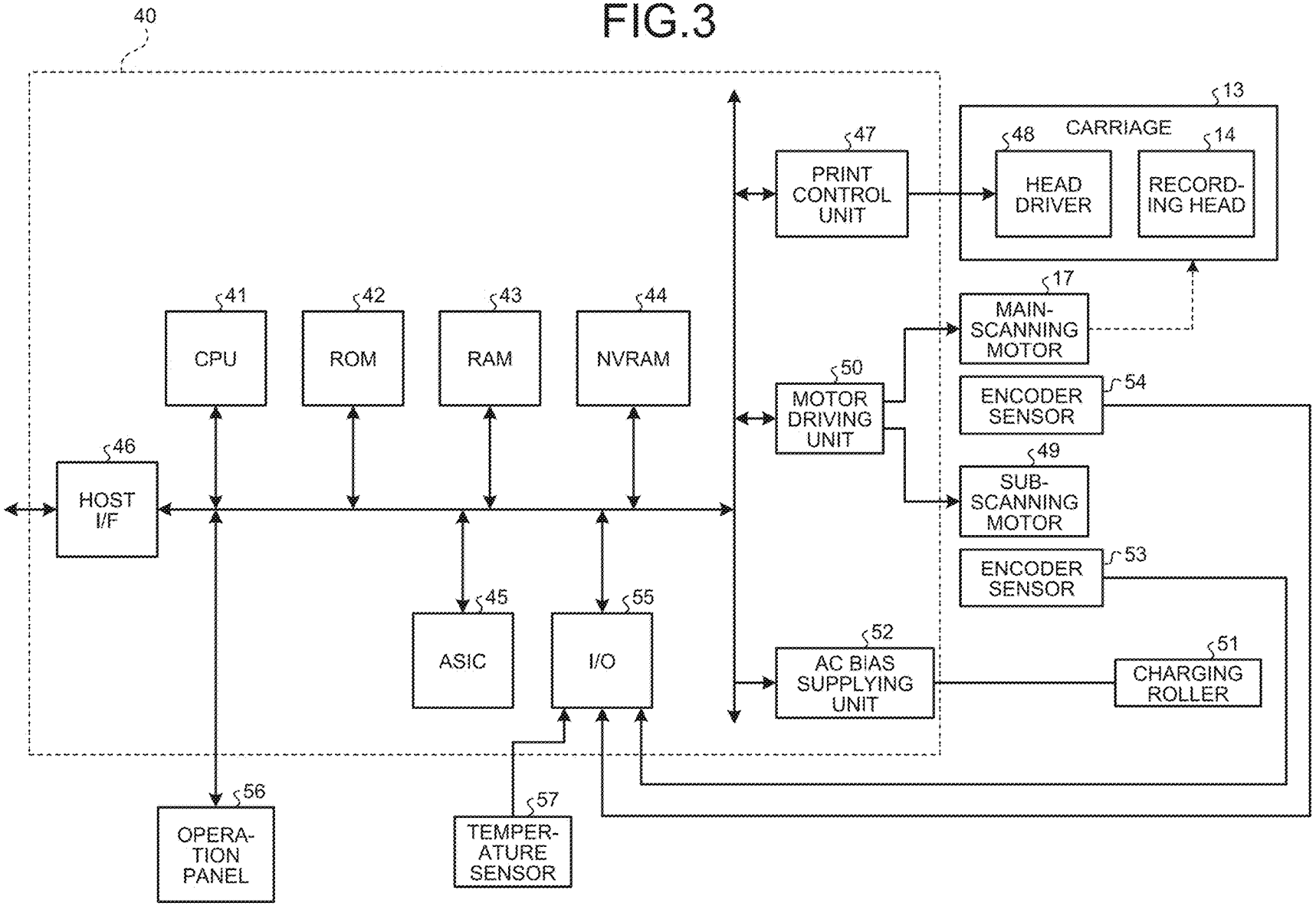
FIG. 3 is a block diagram illustrating a hardware configuration of a control unit of the Inkjet recording device.

Explained below with reference to a block diagram illustrated in FIG. 3 is a brief overview of a control unit of the inkjet recording device 1. A control unit 40 includes a central processing unit (CPU) 41 that controls the entire device; a read only memory (ROM) 42 that is used to store the computer programs to be executed by the CPU 41 and to store other fixed data; a random access memory (RAM) 43 that is used to temporarily store image data; a rewritable nonvolatile memory 44 that holds onto the stored data even when the power to the device is cut off; and an application specific integrated circuit (ASIC) 45 that performs a variety of signal processing with respect to image data, performs image processing for sorting, and processes input-output signals meant for controlling the entire device.

Moreover, the control unit 40 includes a host interface (I/F) 46 that sends data and signals to and receives data and signals from hosts; a print control unit 47 that includes a data transfer unit for performing drive control of the recording heads 14 and a drive waveform generating unit for generating drive waveforms; a head driver (a driver integrated circuit (IC)) 48 that is disposed on the side of the carriage 13 for driving the recording heads 14; a motor driving unit 50 that drives the main-scanning motor 17 and the sub-scanning motor 49; an alternating current (AC) bias supplying unit 52 that supplies an AC bias voltage to a charging roller 51; and input-output (I/O) 55 that is used to receive input of detection signals from encoder sensors 53 and 54 and to receive input of detection signals from various sensors such as a temperature sensor that detects the ambient temperature.

Furthermore, to the control unit 40 is connected an operation panel 56 that is used to input and to display the information required in the inkjet recording device 1. The control unit 40 receives, using the host I/F 46 via a cable or via a network such as a local area network (LAN), image data from hosts including image processing devices such as personal computers, or image reading devices such as image scanners, or imaging devices such as digital cameras. Then, in the control unit 40, the CPU 41 reads and analyzes the print data that is held in the reception buffer provided in the host I/F 46; performs necessary image processing and data sorting using the ASIC 45; and transfers the image data from the print control unit 47 to the head driver 48. Meanwhile, dot pattern data meant for outputting images is generated using a print driver of a host as described later.

The print control unit 47 transfers the image data as serial data to the head driver 48. Moreover, the print control unit 47 outputs, to the head driver 48, transfer blocks and latch signals that are required in transferring the image data or in finalizing the transfer of the image data, and droplet control signals (mask signals). Furthermore, the print control unit 47 includes a digital-to-analog (D/A) converter for performing D/A conversion of the pattern data of driving signals stored in the ROM 42, includes a drive waveform generating unit configured using a voltage amplifier and a current amplifier, and includes a drive waveform selecting unit that is meant for the head driver.

Subsequently, the print control unit 47 generates drive waveforms made of a single drive pulse (drive signal) or a plurality of drive pulses (drive signals), and outputs the drive waveforms to the head driver 48. Then, the head driver 48 drives the recording heads 14 by applying, to the drive elements (for example, the piezoelectric elements) that generate the energy required for selectively discharging the ink droplets from the recording heads 14, the drive signals constituting the drive waveforms that are provided from the print control unit 47 based on the serially-input image data equivalent to a single line of the recording heads 14. At that time, as a result of selecting the drive pulses that would constitute the drive waveforms, it becomes possible to discharge dots of different sizes such as large droplets (large dots), medium droplets (medium dots), and small droplets (small dots).

The CPU 41 calculates a drive output value (a control value) with respect to the main-scanning motor 17 based on a speed target value and a position target value that are obtained as a result of sampling the detection pulses from the encoder sensor 54 constituting a linear encoder and based on a speed target value and a position target value obtained from a speed/position profile stored in advance; and accordingly drives the main-scanning motor 17 via the motor driving unit 50.

In an identical manner, the CPU 41 calculates a drive output value (a control value) with respect to the sub-scanning motor 49 based on a speed target value and a position target value that are obtained as a result of sampling the detection pulses from the encoder sensor 53 constituting a rotary encoder and based on a speed target value and a position target value obtained from the speed/position profile stored in advance. Then, the CPU 41 outputs the drive output value from the motor driving unit 50 to a motor driver, and drives the sub-scanning motor 49 via the motor driver.

Figure 4:
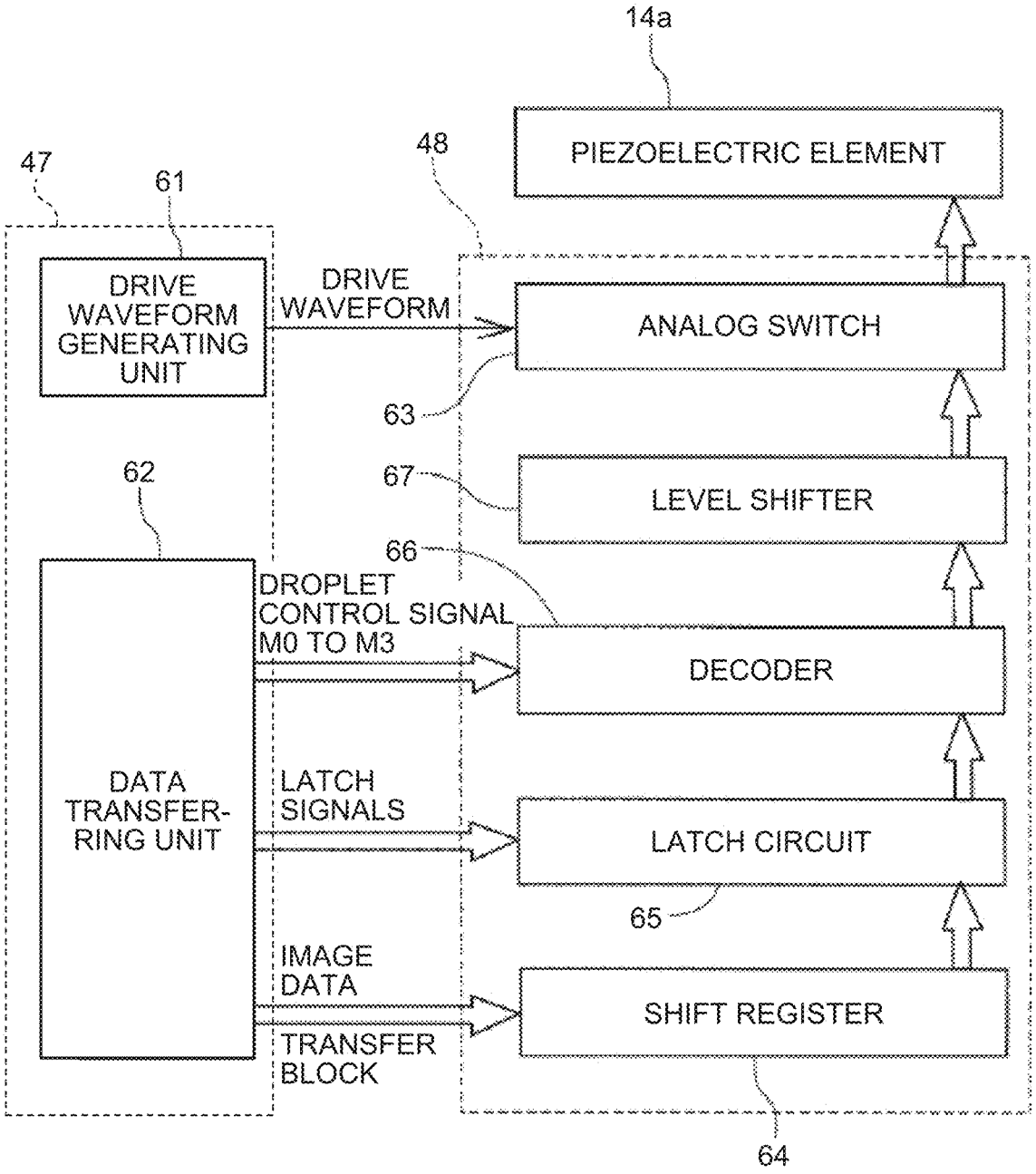
FIG. 4 is a block diagram illustrating an exemplary configuration of a print control unit and a head driver.

Explained below with reference to FIG. 4 is an example of the print control unit 47 and the head driver 48.

The print control unit 41 includes a drive waveform generating unit 61 that generates and outputs drive waveforms made of a plurality of drive pulses (drive signals) in a single printing cycle as described earlier; and includes a data transferring unit 62 that outputs image data according to print images and outputs clock signals, latch signals (LAT), and droplet control signals M0 to M3. Meanwhile, the drive waveform generating unit 61 is disposed in a corresponding manner to each piezoelectric element 14*a*. The droplet control signals are 2-bit signals meant for instructing, on a droplet-by-droplet basis, the opening and closing of an analog switch 63 (described later) representing a switch of the head driver 48; and undergo transition to an H level (ON) for the waveforms that should be selected in accordance with the printing cycle of drive waveforms, and undergo transition to an L level (OFF) when the waveforms are not selected.

The head driver 48 includes a shift register 64 that receives input of a transfer clock (a shift clock) and serial image data (gradation data: 2-bit/CH) from the data transferring unit 62; includes a latch circuit 65 that latches each register value of the shift register 64 using latch signals; includes a decoder 66 that decodes the gradation data and the droplet control signals M0 to M3 and outputs the decoding result; includes a level shifter 67 that performs level conversion of logic-level voltage signals of the decoder 66 into signals at the level at which the analog switch 63 is operable; and includes the analog switch 63 that is switched between ON/OFF states (open/closed states) according to the output of the decoder 66 as provided via the level shifter 67.

The analog switch 63 is connected to the selected electrode (the individual electrode) of each piezoelectric element 14*a*, and receives input of drive waveforms from the drive waveform generating unit 61 disposed corresponding to that piezoelectric element 14*a*. Thus, the analog switch 63 switches to the ON state according to the result of decoding of the serially-transferred image data (gradation data) and decoding of the droplet control signals M0 to M3 as performed by the decoder 66; so that predetermined drive signals constituting drive waveforms pass through (get selected) and get applied onto the piezoelectric elements 14*a*.

With the configuration and the control method described above, images are formed as a result of the discharge of inks from the recording heads 14.

Figure 5:
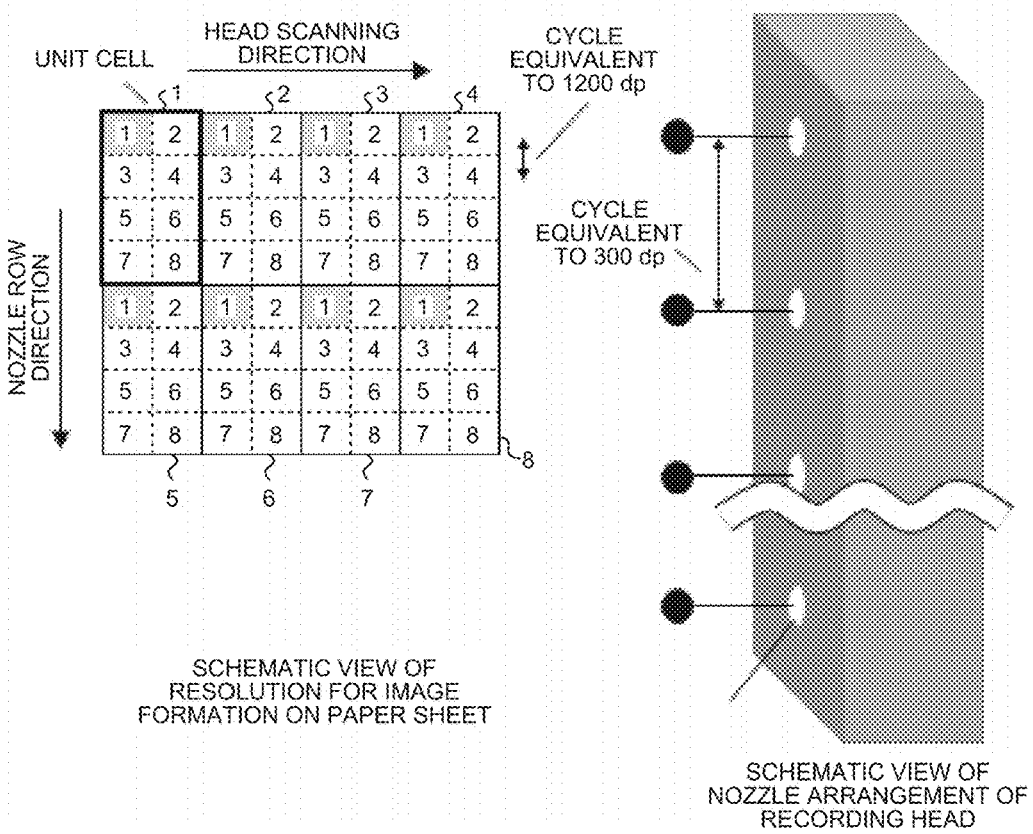
FIG. 5 is an explanatory diagram for explaining a method for forming images in the inkjet recording device.

Explained below with reference to FIG. 5 is a method for forming images in the inkjet recording device representing an example of the embodiments.

The resolution for image formation has a plurality of modes depending on the image quality, the output speed, and the paper type. Herein, as an example, the explanation is given about the mode in which the image quality is given priority. In the mode having priority to the image quality, the resolution for image formation is (1200 dpi)×(1200 dpi) (where dpi stands for dot per inch, and represents the unit for resolution indicating the number of dots formed per inch).

Meanwhile, the nozzle density formed on a head-by-head basis is 300 dpi. Hence, in order to achieve the resolution of 1200 dpi in the nozzle row direction, head scanning needs to be repeated for a least four times while shifting the cycle equivalent to 1200 dpi in the nozzle direction. Moreover, regarding the image formation in the head scanning direction too, head scanning is performed in two installments for achieving error variance of image formation. That is, in order to complete the image formation of a particular area (a unit cell), head scanning needs to be repeated for eight times (=(four times in nozzle row direction)×(two times in main-scanning direction)).

In the actual operations, in order to achieve diffusion of the nozzle-by-nozzle discharge variation, instead of using the same nozzle row to print the unit cells illustrated in FIG. 5, printing is performed by moving the heads in the nozzle row direction by a predetermined amount after every time of scanning.

Figure 6:
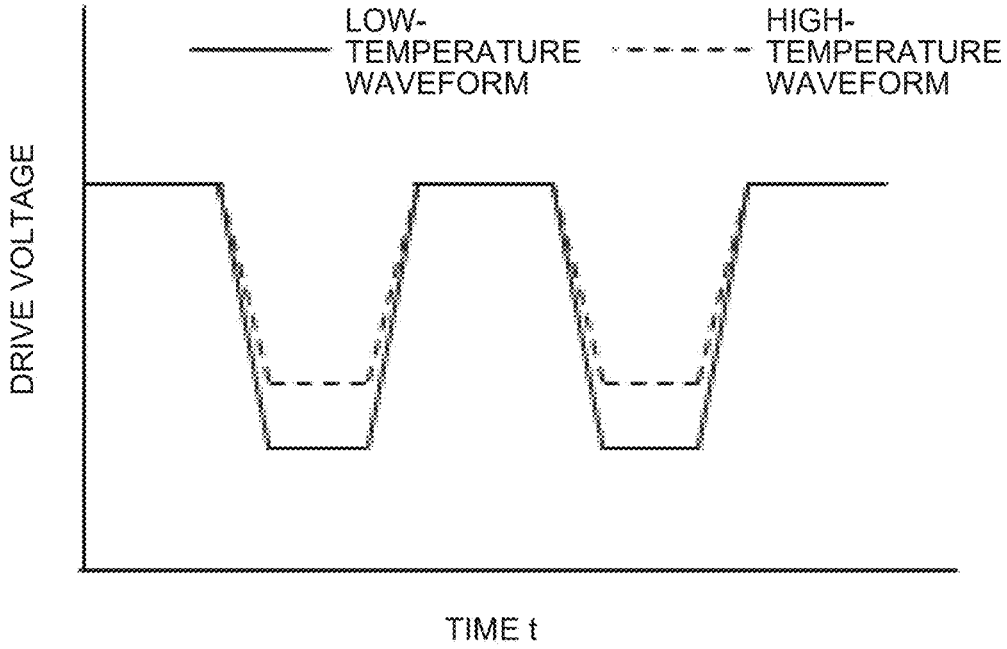
FIG. 6 is an explanatory diagram for explaining the waveforms used in driving recording heads.

Explained below with reference to FIG. 6 are the waveforms used in driving the recording heads.

The drive waveforms are generated by the drive waveform generating unit 61 (disposed for each piezoelectric element 14*a*) of the print control unit 47 illustrated in FIG. 4; the nozzles to be used for discharging and the waveform type are selected by the head driver 48; and the drive waveforms are supplied to the piezoelectric elements 14*a* of the recording heads 14 (see FIG. 3). The control unit selects the type of the drive waveforms according to the temperature detected by a temperature sensor 57 (see FIG. 3). For example, as illustrated in FIG. 6, generally, in order to ensure that the ink viscosity becomes higher in a low-temperature environment, a higher voltage is input to the piezoelectric elements, thereby resulting in a higher voltage than the voltage of the waveforms at a high temperature.

As described above, the ink viscosity changes due to the effect of the ambient temperature. Hence, according to the changes in the ambient temperature, the drive waveforms that are meant for driving the piezoelectric elements also need to be varied. In other words, according to the changes in the ambient temperature, the drive waveforms of the piezoelectric elements need to be corrected. As a result of performing such correction, the discharging amount and the discharging speed of the inks can be maintained at a constant level, and any decline in the images recorded on the paper sheets can be held down.

In the embodiments, more specifically, the variation in the ink discharging speed and the ink discharging amount is held down by correcting the waveform of a drive waveform signal Vcomx in the print control unit 47.

Figure 7:
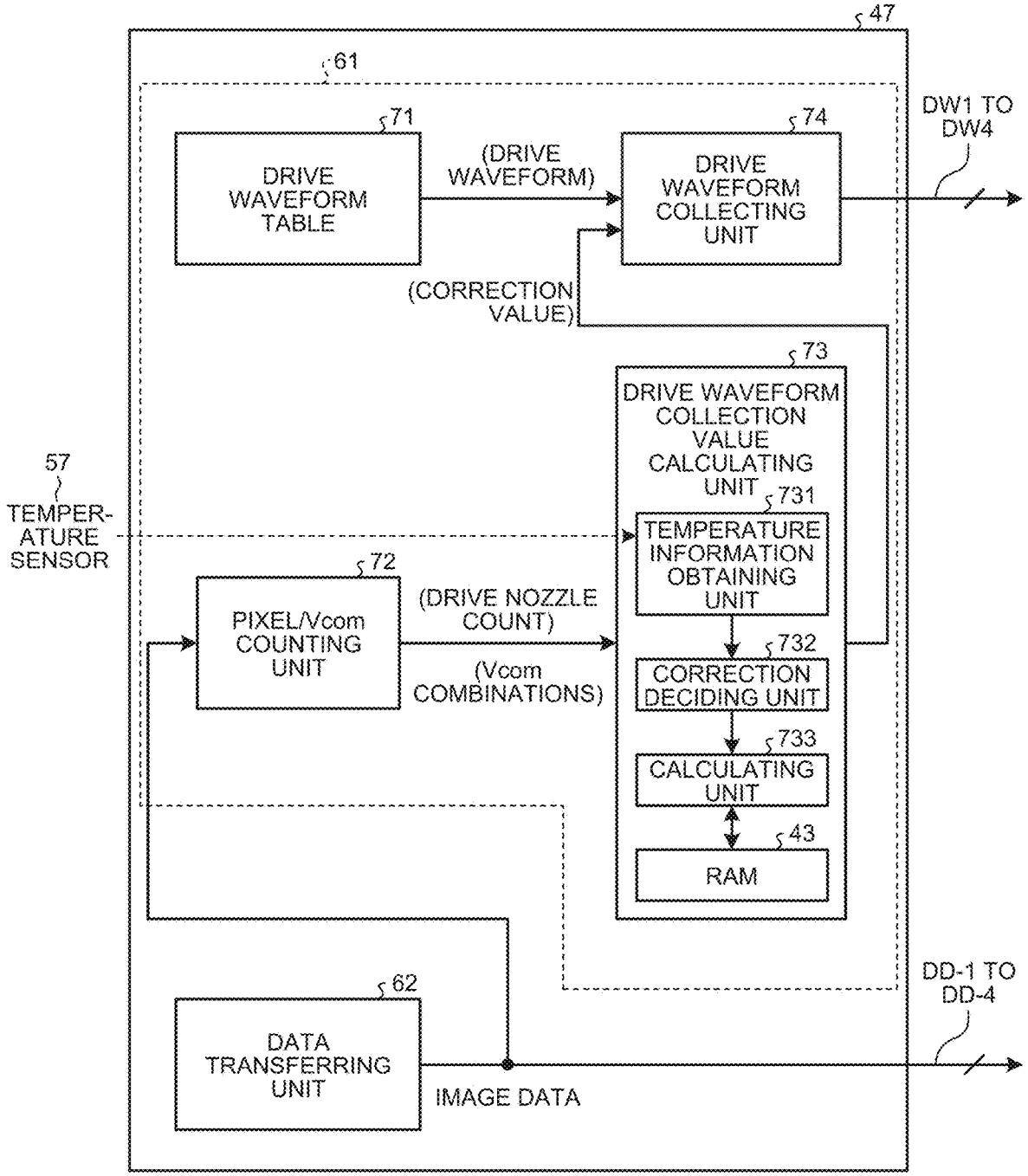
FIG. 7 is a block diagram illustrating a functional configuration of the print control unit.

FIG. 7 is a block diagram illustrating a functional configuration of the print control unit 47. The print control unit 47 includes a drive waveform table 71 in which reference drive waveform data is stored in advance as data to be output; includes the data transferring unit 62 that holds image data DD-1 to image data DD-4 to be output in the next cycle, and that outputs the image data; includes a pixel/Vcom counting unit 72 that, based on the input image data DD-1 to DD-4, outputs the to-be-driven nozzle count for the next cycle and outputs the combinations of drive waveform signals Vcom1 to Vcom4 to be output in the next cycle; includes a drive waveform correction value calculating unit 73 that calculates and outputs a drive waveform magnification correction value based on the input value of the temperature detected by the temperature sensor 57 (see FIG. 3); and includes a drive waveform correcting unit 74 that corrects the reference drive waveform, which is input, using the input drive waveform magnification correction value, and outputs, to the head driver 49, drive waveform control data DW1 to DW4 that is based on the drive nozzle count and the combinations of the drive waveform signals Vcom1 to Vcom4. Herein, the drive waveform table 71, the pixel/Vcom counting unit 72, the drive waveform correction value calculating unit 73, and the drive waveform correcting unit 74 constitute the drive waveform generating unit 61 (disposed for each piezoelectric element 14*a*).

More particularly, the drive waveform correction value calculating unit 73 includes a temperature information obtaining unit 731, a correction deciding unit 732, and a calculating unit 733. The RAM 43 is used to store a drive waveform correction table in which a drive waveform magnification correction value corresponding to each drive waveform is stored.

The temperature information obtaining unit 731 receives input of the temperature value output by the temperature sensor 57 and obtains the temperature information in the vicinity of the heads.

The correction deciding unit 732 compares, for each time of head scanning, the temperature value that is obtained as the initial value in the vicinity of the heads by the temperature information obtaining unit 731 with the post-scanning temperature value obtained in the vicinity of the heads by the temperature information obtaining unit 731; and, if the temperature difference exceeds a threshold value (for example, 1° C.), decides that the drive waveforms need to be corrected.

When the correction deciding unit 732 decides to perform correction, for each time of remaining scanning in the scanning area (for example, the unit cell being scanned), the calculating unit 733 calculates and outputs the drive waveform correction value. In the mode explained with reference to FIG. 5, each unit cell is subjected to head scanning for a plurality of times, and image formation is completed. Thus, for each time of remaining scanning of the scanning area (for example, the unit cell being scanned), the calculating unit 733 gradually increases, in the sequence according to a predetermined algorithm, the number of such piezoelectric elements, from among the piezoelectric elements of a plurality of nozzles constituting the recording heads, which are to be used in correcting the drive waveforms; and obtains the respective drive waveform magnification correction values from the drive waveform correction table and outputs them to the drive waveform correcting unit 74. Meanwhile, regarding the information indicating the unit cell numbers and indicating the scanning count in each unit cell, based on the image data output from the data transferring unit 62, the pixel/Vcom counting unit 72 outputs the information to the drive waveform correction value calculating unit 73 along with the drive nozzle count and the combinations of the drive waveform signals Vcom1 to Vcom4.

Given below is the explanation of a drive waveform correction operation performed by the print control unit 47 configured in the manner described above. Herein, in order to facilitate understanding, the redundant explanation is not given again.

The data transferring unit 62 outputs the image data DD-1 to DD-4, which is stored as image data to be output in the next cycle, to the pixel/Vcom counting unit 72.

Based on the image data DD-1 to DD-4 input thereto, the pixel/Vcom counting unit 72 outputs, to the drive waveform correction value calculating unit 73, the drive nozzle count and the combinations of the drive waveform signals Vcom1 to Vcom4 to be output in the next cycle. Moreover, based on the image data output from the data transferring unit 62, the pixel/Vcom counting unit 72 outputs the information such as the unit cell numbers and the scanning count in each unit cell.

The drive waveform correction value calculating unit 73 outputs the drive nozzle count and the drive waveform signals Vcom1 to Vcom4 to the drive waveform correcting unit 74. Moreover, the drive waveform correction value calculating unit 73 outputs the drive waveform magnification correction values to the drive waveform correcting unit 74. When the temperature in the vicinity of the heads exceeds the threshold value, as the scanning count increases in the subsequent iterations of remaining scanning, the drive waveform correction value calculating unit 73 increments the correction count for the drive waveforms of the piezoelectric elements of the nozzles constituting the recording heads (i.e., increments the count for which the drive waveform magnification exceeds 1).

As a result, when the reference drive waveform data is input from the drive waveform table 71, the drive waveform correcting unit 74 performs correction using the drive waveform magnification correction values that have been input, and outputs the drive waveform control data DW1 to DW4 to the head driver 48.

Figure 8:
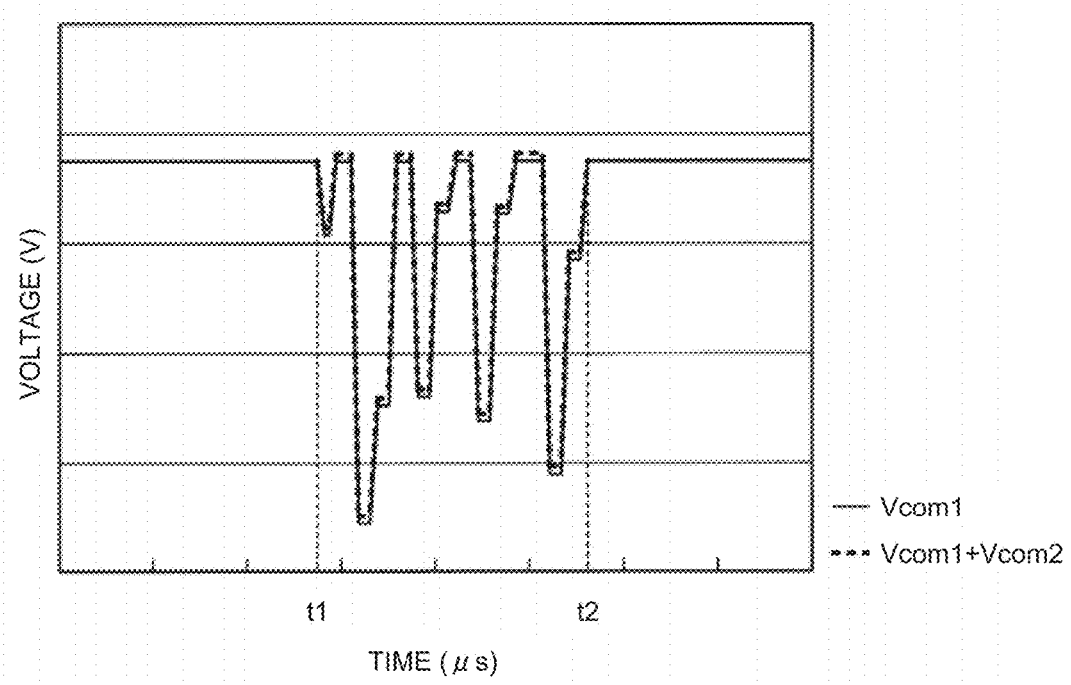
FIG. 8 is an explanatory diagram illustrating an example of drive waveform correction.

FIG. 8 is an explanatory diagram illustrating an example of drive waveform correction. As illustrated in FIG. 8, when the reference drive waveform data (having the drive waveform magnification equal to 1) is input from the drive waveform table 71, the drive waveform magnification correction value is multiplied to the portion excluding the intermediate electrical potential while keeping the intermediate electrical potential to a constant level, and the drive waveform control data DW1 and DW4 is obtained. In the example illustrated in FIG. 8, the reference drive waveform data is multiplied by the drive waveform multiplication correction value of "1.2" and the drive waveform control data DW1 and DW4 is obtained. As a result, the voltage fluctuation is held down, and the variation in the ink discharging speed and the ink discharging amount is also held down.

In the embodiments, since the time of taking the decision on varying the drive waveforms till the completion of the variation in the drive waveforms, a predetermined process is set. The process for varying the drive waveforms contributes in holding down the unevenness in the density of the images that occurs at the time of correcting the drive waveforms.

Figure 9:
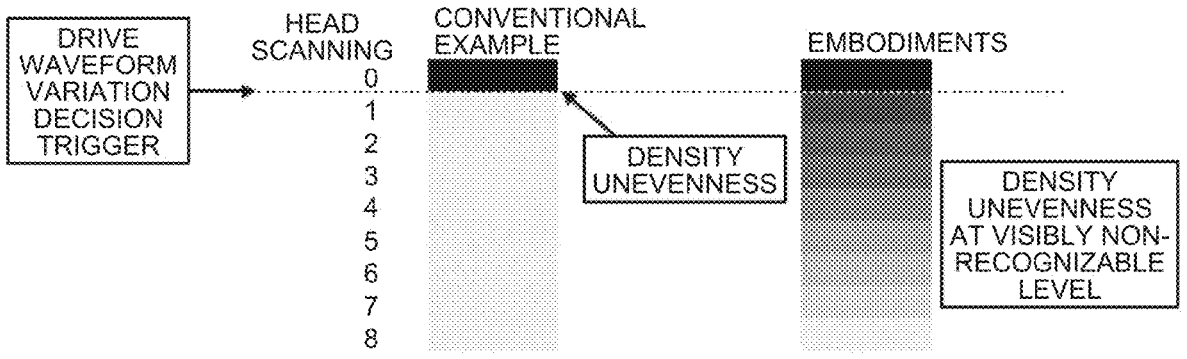
FIG. 9 is an explanatory diagram for explaining a drive waveform control method.

In the conventional drive waveform correction, when the change in the ambient temperature exceeds the threshold value (for example, 1° C.), it is decided to vary the drive waveforms, and the drive waveforms of the drive piezoelectric elements of all nozzles of the recording heads are varied at once. As a result, as illustrated in FIG. 9, there occurs visibly recognizable density unevenness between the density of the inks attached to the recorded images prior to the variation in the drive waveforms and the density of the inks attached to the recorded images after the variation in the drive waveforms.

As described earlier with reference to FIG. 5, in the case of forming images by discharging inks from the nozzles of the recording heads onto a paper sheet, for example, the paper sheet is divided into some areas called unit cells (in FIG. 5, eight areas, namely, unit cells 1 to 8), and recording-scanning by the recording heads is performed for eight times for each unit cell to complete the image formation. Herein, the number of unit cells and the recording-scanning count is decided based on the relationship between the resolution of the images to be recorded for example, 1200 dpi) and the nozzle density (for example, 300 dpi) of the recording heads to be used in recording. Meanwhile, the recording-scanning mentioned above implies the operation in which liquids are discharged from a plurality of nozzles of the recording heads while scanning the recording heads with respect to the target paper sheet.

In the embodiments, during the recording-scanning performed by the recording heads after it has been decided to vary the drive waveforms of the piezoelectric elements of the nozzles of the recording heads, in between the initial time of recording-scanning to the eighth time of recording-scanning performed last, the drive waveforms of the piezoelectric elements of the nozzles of the recording heads are so controlled that the variation count gradually increases from pre-variation-decision first-type drive waveforms to post-variation second-type drive waveforms; and, during the eighth time of recording-scanning performed last, the variation to new drive waveforms is completed in all piezoelectric elements. As a result, as illustrated in FIG. 9, in the embodiments, in the recorded images formed after the variation in the drive waveforms has been decided, the unevenness in the density of the inks can be held down to a visibly non-recognizable level.

In the embodiments, two examples (a first embodiment and a second embodiment) are proposed as specific configurations for gradually varying, according to the changes in the ambient temperature, the drive waveforms of the drive elements (piezoelectric elements) of a plurality of nozzles of the recording heads by proportionating the variation to the recording-scanning performed for a plurality of number of times during image formation.

First Embodiment

Explained below with reference to FIG. 5 is a process for varying the drive waveforms according to the first embodiment. In the example illustrated in FIG. 5, the paper sheet representing the recording target is divided into areas 1 to 8 (the unit cells 1 to 8), and recording-scanning of each unit cell is performed for eight times using the recording heads. In the first embodiment, each unit cell is internally divided into eight areas (cells). Then, during the first time of scanning, the piezoelectric elements of the nozzles intended for scanning the cell 1 in each unit cell are driven using new drive waveforms. Then, during the second time of scanning, in addition to the variation in the drive waveforms of the piezoelectric elements of the nozzles intended for scanning the cell 1, the drive waveforms of the piezoelectric elements of the nozzles intended for scanning the cell 2 are also varied. Subsequently, during the third time of scanning, the drive waveforms of the piezoelectric elements of the nozzles intended for scanning the cell 3 are further varied. In this way, during the eighth time of scanning, regarding the piezoelectric elements for scanning all of the cells 1 to 8 of each of the unit cells 1 to 8, the drive waveforms are varied to new drive waveforms. As a result, as illustrated in FIG. 9, in the image formed on the paper sheet, the density of the recording inks accompanying the variation in the drive waveforms gradually changes In proportion to the increase in the scanning count, and the unevenness in the density of the inks can be held down to a visibly non-recognizable level. In the first embodiment, regarding the variation in the drive waveforms of the piezoelectric elements of the nozzles intended for scanning a particular cell, the variation is performed in order from the cell 1 to the cell 8. However, the increase in the number of cells to be scanned using the second-type drive waveforms is not limited to the ascending order of the cell numbers, and can be performed in random order. In essence, from the first time of scanning to the eighth time of scanning, as long as all drive waveforms of a plurality of nozzles are gradually changed from the state of being driven using the first-type drive waveforms to the state of being driven using the second-type drive waveforms, it serves the purpose.

Figure 10:
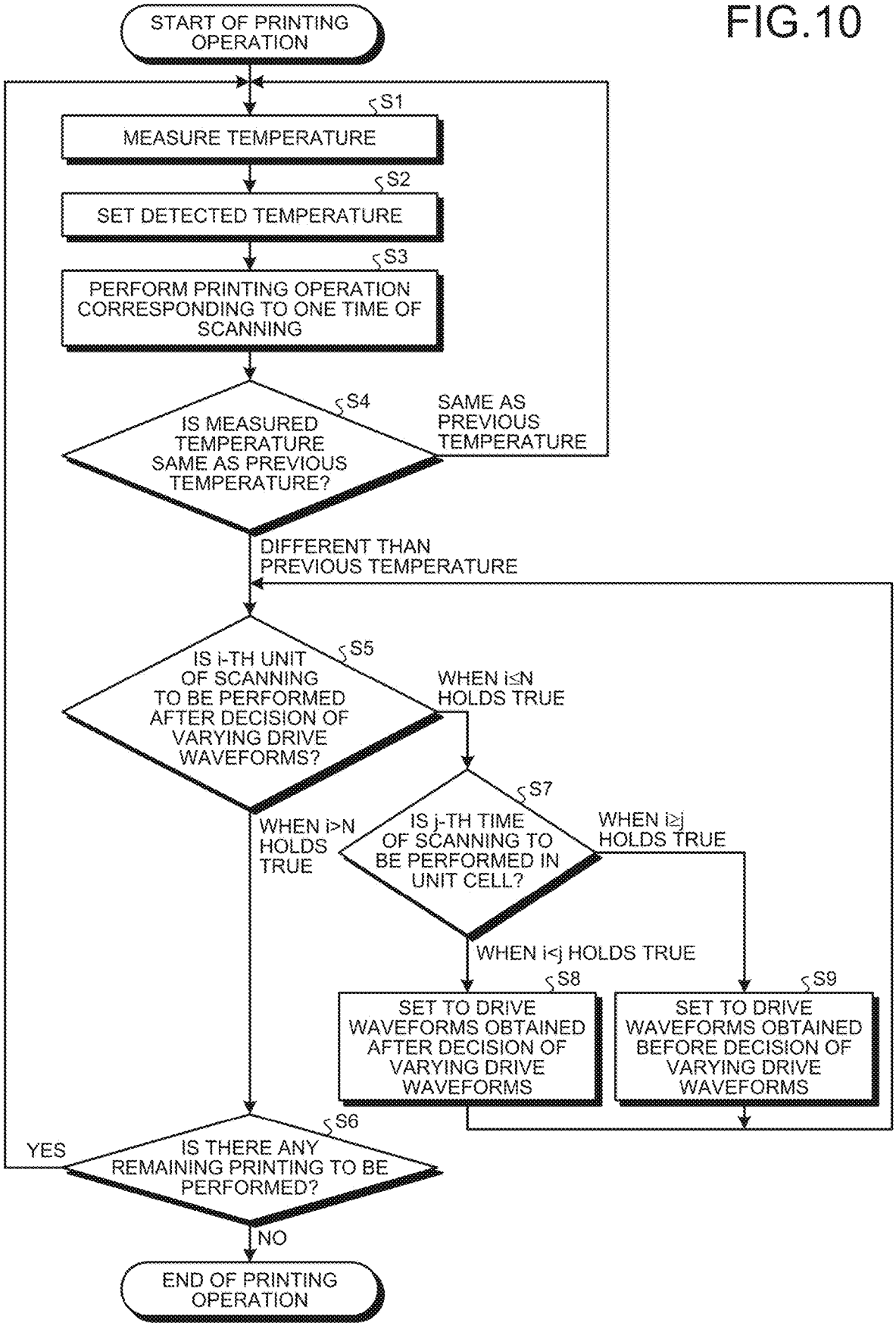
FIG. 10 is a flowchart for explaining an exemplary flow of performing drive waveform control according to a first embodiment.

FIG. 10 is a flowchart for explaining a flow of performing drive waveform control according to the first embodiment. With reference to FIG. 10, N represents the number of unit cells, i represents the current unit cell, and j represents the scanning count in each unit cell.

When the print control is started, the temperature in the vicinity of the recording heads is measured (Step S1). Then, the detected temperature is set (Step S2). Subsequently, the printing operation corresponding to one time of scanning is performed (Step S3). Then, the temperature in the vicinity of the recording heads is measured and it is determined whether the measured temperature is same as the earlier detected temperature (Step S4). Regarding the determination about whether the temperatures are same, for example, it is determined whether the temperature difference is smaller than 1° C. or is equal to or greater than 1° C.

When the measured temperature is same as the earlier detected temperature, the system control returns to Step S1. However, if the measured temperature is different than the earlier detected temperature, then it is determined whether the current unit cell number i is greater than the count N (whether i>N holds true) or whether the current unit cell number i is equal to or smaller than the count N (whether i≤N holds true) (Step S5). If the current unit cell number i is greater than the count N (if i>N holds true), then it is determined whether there is any remaining printing to be performed (Step S6). If there is no remaining printing to be performed, then the printing operation is ended. However, if there is any remaining printing to be performed, then the system control returns to Step S1.

At Step S5, if it is determined that the current unit cell number i is equal to or smaller than the count N (if i≤N holds true), then it is determined whether the scanning count in the unit cell is equal to or greater than j (whether i≥j holds true) or whether the scanning count in the unit cell is smaller than j (whether i<j holds true) (Step S7).

If the scanning count in the unit cell is greater than i (if i<j holds true), then the first-type drive waveforms after deciding to vary the drive waveforms are set as drive waveforms (Step S8). Then, the system control returns to Step S5. However, if the scanning count in the unit cell is no more than i (if i≥j holds true), then the second-type drive waveforms before the decision to vary the drive waveforms has been taken are set as drive waveforms (Step S9). Then, the system control returns to Step S5.

Figure 11:
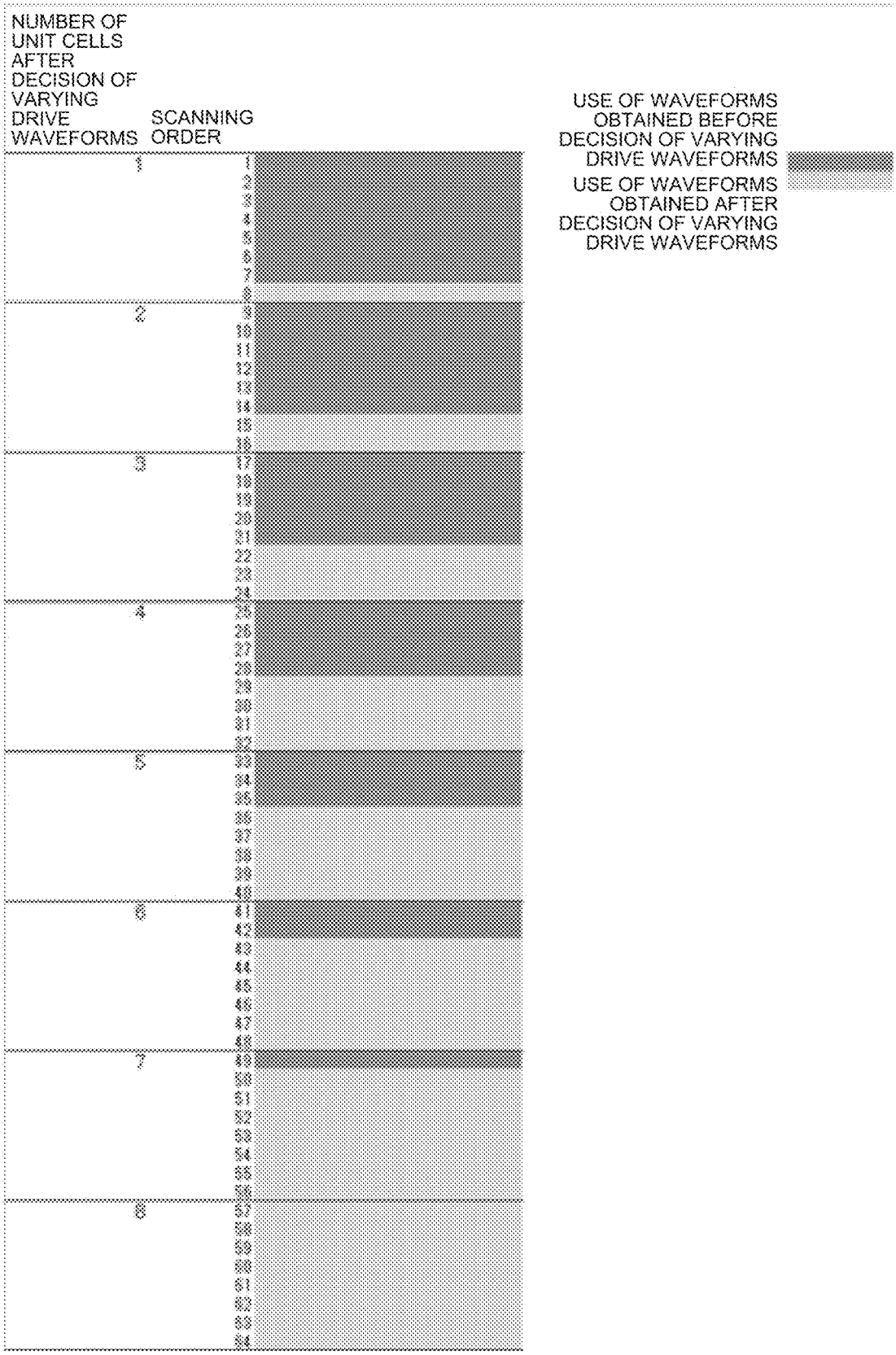
FIG. 11 is an explanatory diagram for explaining an example of switching control of drive waveforms according to the first embodiment.

As a result of following the control flow illustrated in FIG. 10, it results in the switching control of the drive waveforms as illustrated in FIG. 11. In FIG. 11, a "scanning order" item represents the order of temporal scanning, and whether the first-type drive waveforms prior to the decision on drive waveform variation are to be used in a particular scanning or whether the second-type drive waveforms after the decision on drive waveform variation are to be used in particular scanning is indicated in the display of grey cells on the right-hand side. Moreover, a "number of units after decision of varying drive waveforms" item indicates the number of units for which eight times of scanning has been performed after the decision of varying the drive waveforms. After it is decided to vary the drive waveforms, the frequency of occurrence of the first-type drive waveforms before and after the decision of varying the drive waveforms gradually goes on decreasing during unit scanning. Meanwhile, the control flow illustrated in FIG. 10 is only exemplary, and it is alternatively possible to follow any other control flow as long as the probability of occurrence of the second-type drive waveforms after the decision of varying the drive waveforms gradually goes on increasing.

Figure 12:
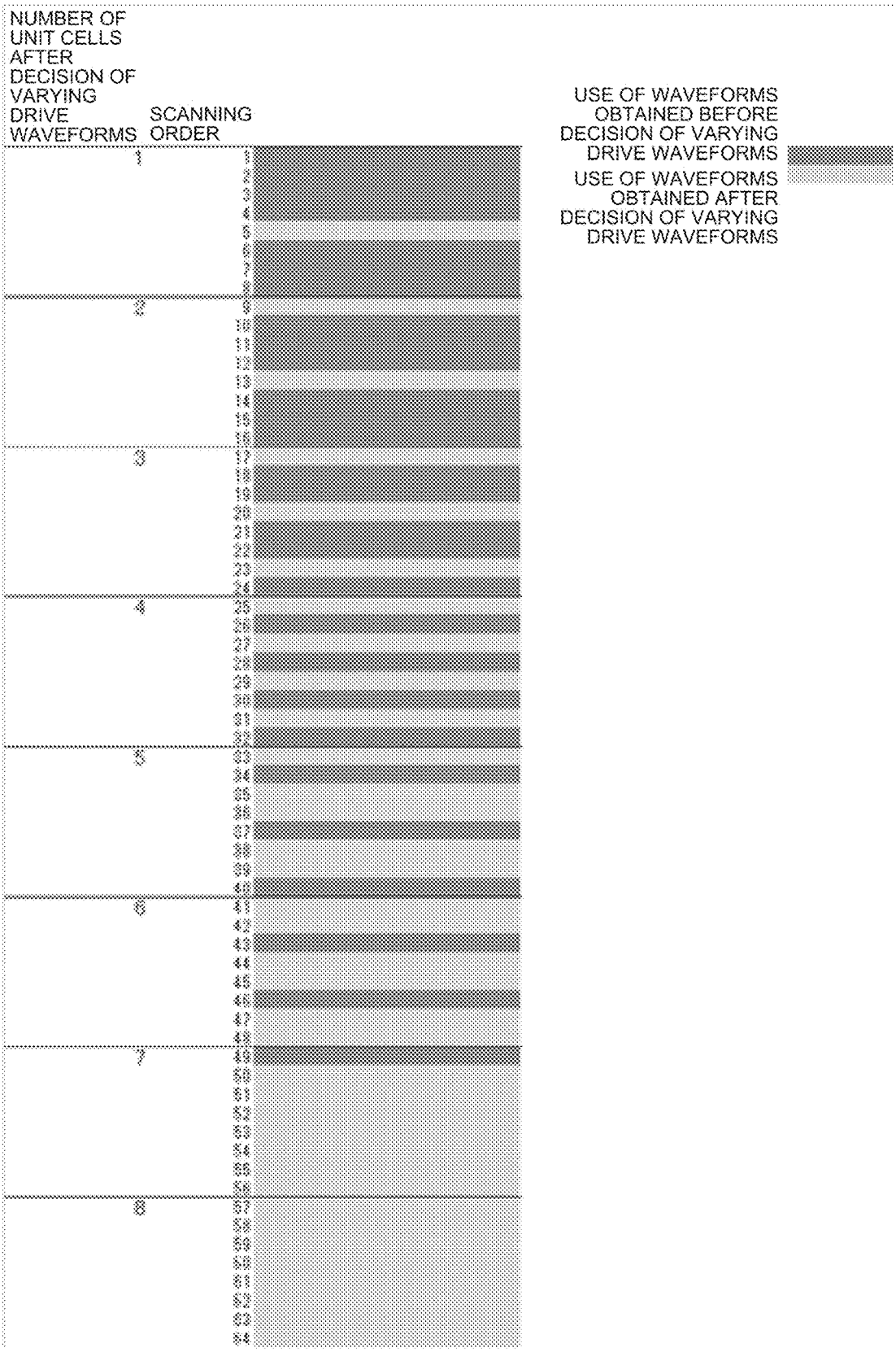
FIG. 12 is a diagram for explaining another example of switching control of drive waveforms according to the first embodiment.

FIG. 12 is a diagram for explaining another control flow. According to this control flow, after it is decided to vary the drive waveforms, the frequency of occurrence of the first-type drive waveforms before and after the decision of varying the drive waveforms gradually goes on decreasing during unit scanning; and moreover the pre-variation first-type drive waveforms and the post-variation second-type drive waveforms are temporally dispersed. As a result, the density variation of the density unevenness portion can be set to be smoother.

Second Embodiment

In the process for varying the drive waveforms according to a second embodiment, for example, the paper sheet representing the discharging target is divided into areas 1 to 8 (unit cells 1 to 8), and scanning of each unit cell is performed for eight times using the recording heads. During the first time of scanning, of all the nozzles used for scanning from the unit cell 1 to the unit cell 8, ⅛-th of the drive waveforms are varied to the second-type drive waveforms. During the second time of scanning, of all the nozzles used for scanning from the unit cell 1 to the unit cell 8, ⅔-th of the drive waveforms are varied to the second-type drive waveforms. During the third time of scanning, of all the nozzles used for scanning from the unit cell 1 to the unit cell 8, ⅜-th of the drive waveforms are varied to the second-type drive waveforms. In this way, in the eighth time of scanning, of all the nozzles used for scanning from the unit cell 1 to the unit cell 8, all of the drive waveforms are varied to the second-type drive waveforms.

Figure 13:
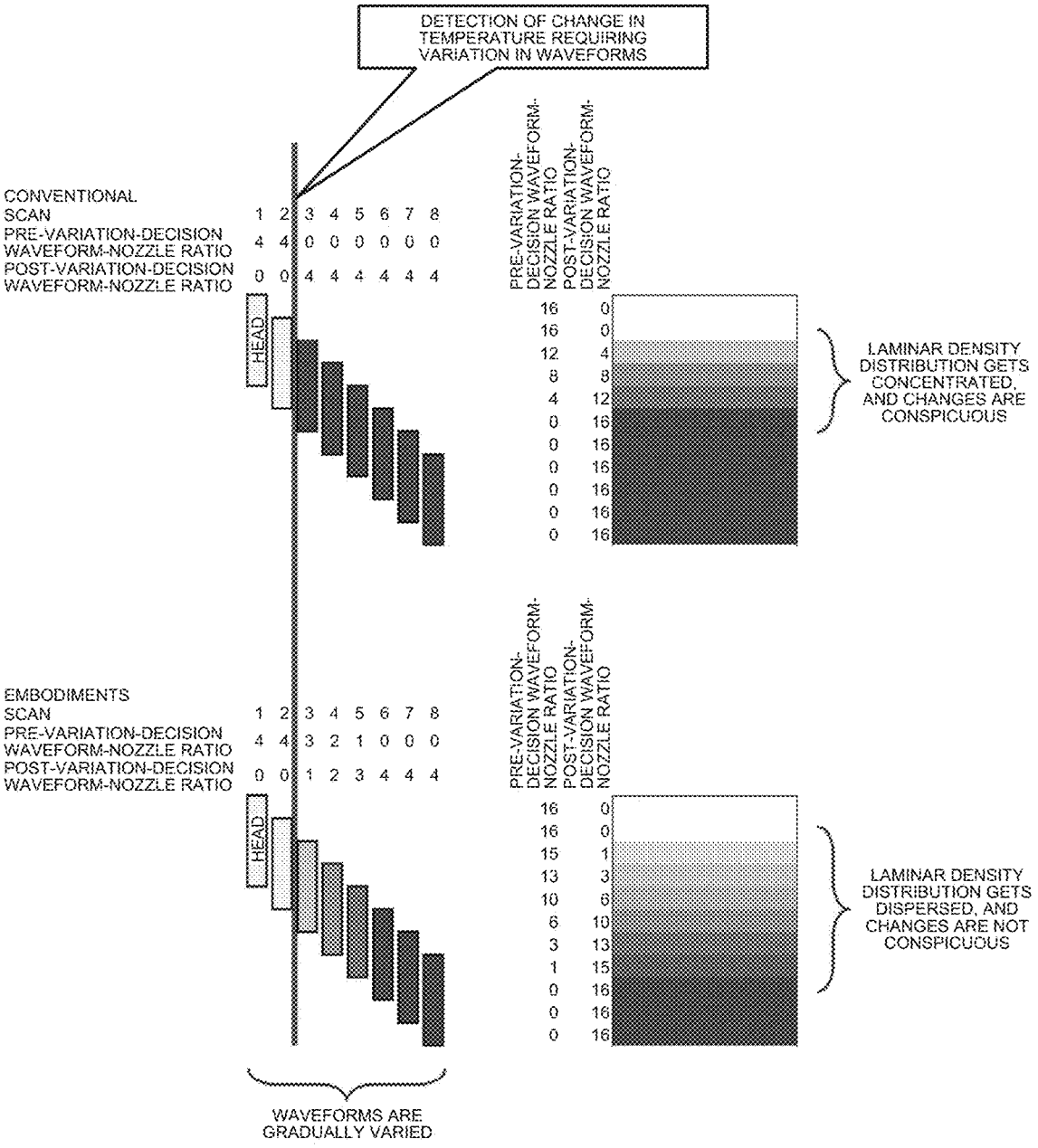
FIG. 13 is an explanatory diagram for explaining an example of switching control of drive waveforms according to a second embodiment.

In the example illustrated in FIG. 13, the control of drive waveforms is illustrated in the case In which, at the point of time when the eight times of scanning is completed twice, it is decided to vary the drive waveforms based on the temperature measured in the vicinity of the heads. In that case, from the third time scanning, the number of nozzles to be driven using the second-type drive waveforms is increased and control is performed in such a way that all nozzles are driven using the second-type drive waveforms during the eighth time of scanning performed last. The order of nozzles for which the drive waveforms are varied can be the order of arrangement of the nozzles (ascending order or descending order), or can be random order. In essence, from the first time of scanning to the eight time of scanning, as long as the drive waveforms of all nozzles are gradually changed from the state of being driven using the first-type drive waveforms to the state of being driven using the second-type drive waveforms, it serves the purpose.

Figure 14:
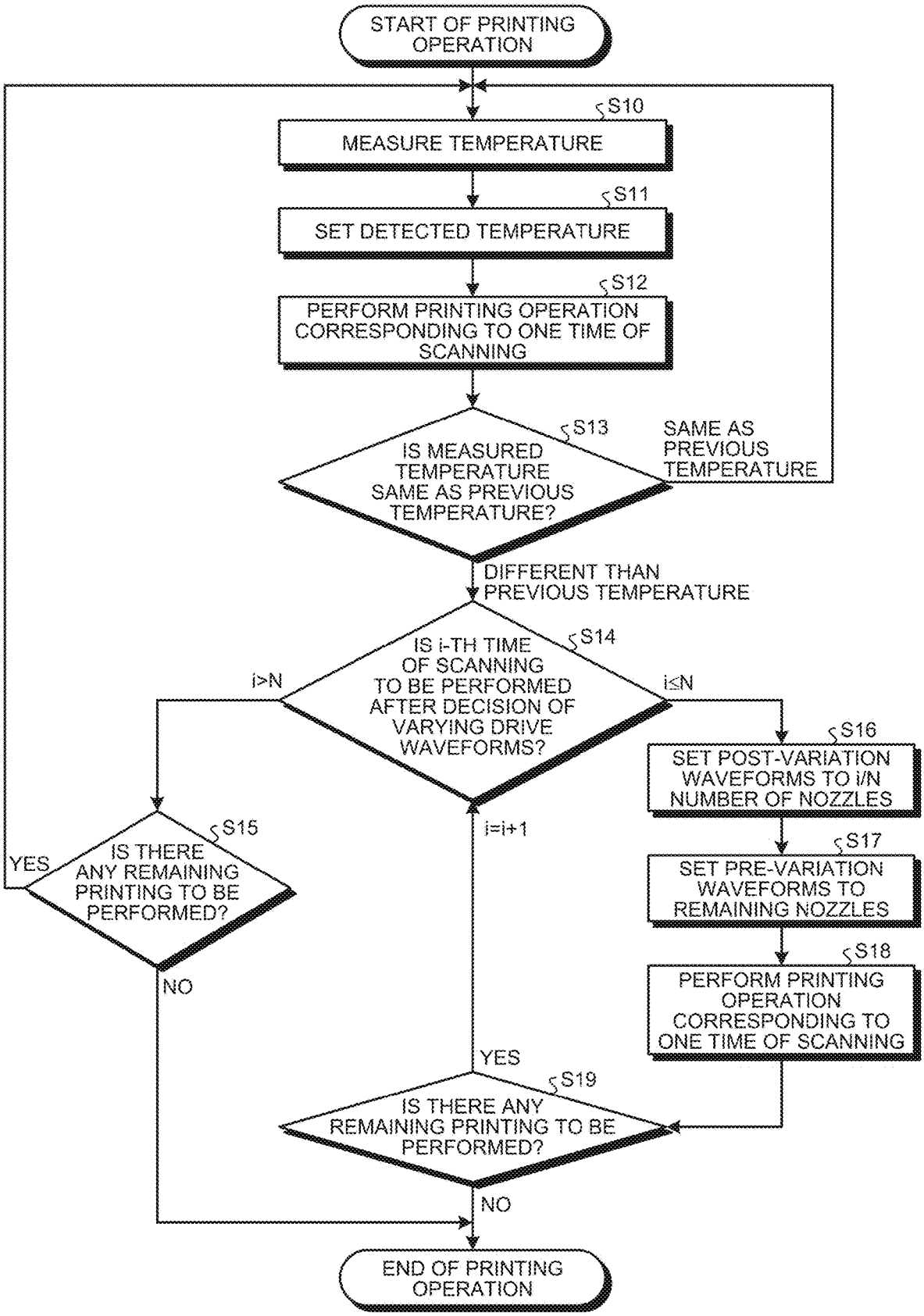
FIG. 14 is a flowchart for explaining an exemplary flow of performing drive waveform control according to the second embodiment.

FIG. 14 is a flowchart for explaining a flow of performing drive waveform control according to the second embodiment. With reference to FIG. 14, N represents the total scanning count required until completion of image formation, and i represents the current scanning count.

When the print control is started, the temperature in the vicinity of the recording heads is measured (Step S10). Then, the detected temperature is set (Step S11). Subsequently, the printing operation corresponding to one time of scanning is performed (Step S12). Then, the temperature in the vicinity of the recording heads is measured and it is determined whether the measured temperature is same as the earlier detected temperature (Step S13). Regarding the determination about whether the temperatures are same, for example, it is determined whether the temperature difference is smaller than 1° C. or equal to or greater than 1° C.

When the measured temperature is same as the earlier detected temperature, the system control returns to Step S10. However, if the measured temperature is different than the earlier detected temperature, then it is determined whether the current scanning count i is greater than the total scanning count N (whether i>N holds true) or whether the current scanning count i is equal to or smaller than the count N (whether i≤N holds true) (Step S14). If the current scanning count i is greater than the total scanning count N (if i>N holds true), then it is determined whether there is any remaining printing to be performed (Step S15). If there is no remaining printing to be performed, then the printing operation is ended. However, if there is any remaining printing to be performed, then the system control returns to Step S10.

At Step S14, if it is determined that the current scanning count i is equal to or smaller than the total scanning count N (if i≤N holds true), then the second-type drive waveforms are set for i/N number of nozzles (Step S16) and the remaining nozzles are still set with the first-type drive waveforms (Step S17). Then, the printing operation in the first time is performed (Step S18) and it is determined whether there is any remaining printing to be performed (Step S19). If there is no remaining printing to be performed, then the printing operation is ended. However, if there is any remaining printing to be performed, then the scanning count i is incremented by 1 (i.e., i=i+1) and the system control returns to Step S14.

As a result of implementing the method of controlling the second-type drive waveforms according to the second embodiment too, it is possible to achieve the same effects as achieved by implementing the method of controlling the second-type drive waveforms according to the first embodiment described earlier.

Other Working Examples Regarding Print Control Unit and Head Driver

Figure 15:
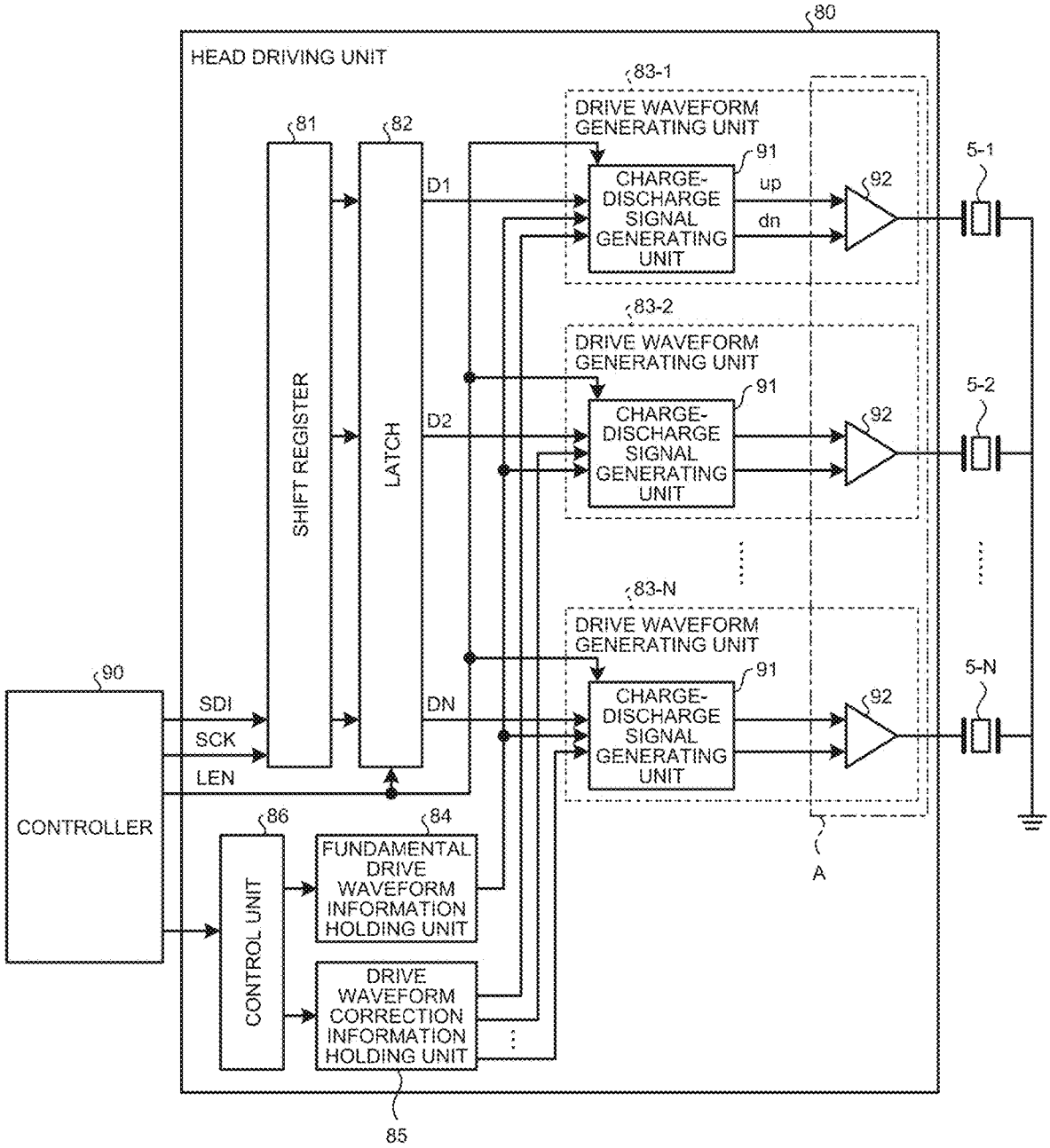
FIG. 15 is a diagram illustrating another example of the configuration of the print control unit and the head driver.

FIG. 15 is a diagram illustrating another example of the configuration of the print control unit and the head driver. With reference to FIG. 15, a controller 90 and a head driving unit 80 correspond to the print control unit and the head driver, respectively.

The head driving unit 80 is configured to drive N number of piezoelectric elements 5 (piezoelectric elements 5-1 to 5-N) corresponding to N number of nozzles provided in the recording heads. Thus, the piezoelectric elements 5 in a single nozzle row of the recording heads are driven by the head driving unit 80.

Of each piezoelectric element 5, one electrode is connected to a common potential (such as ground) along with other piezoelectric elements 5 via a flexible printed circuit (FPC) board that transmits drive waveforms, and the other electrode is connected to the head driving unit 80.

The head driving unit 80 is configured with one or more integrated circuits, and at least the portion that is connected to the piezoelectric elements 5 is installed on the FPC board. Based on the data transferred from the controller 90; the head driving unit 80 drives the piezoelectric elements 5 by individually generating optimum drive waveforms for the piezoelectric element 5 corresponding to each nozzle in such a way that ink droplets are discharged from each nozzle in the appropriate state.

Meanwhile, alternatively, the head driving unit 80 can be installed in an integrated manner with the recording heads.

The controller 90 separates the image to be printed into sets of image data corresponding to the recording heads and the nozzle rows, and transfers the sets of image data to the head driving unit 80. Moreover, the controller 90 has the function of transferring fundamental drive waveform information and drive waveform correction information, which are used at the time of generating the drive waveforms using the head driving unit 80, and setting that information in the head driving unit 80; and has the function of supplying various control signals to the head driving unit 80.

As illustrated in FIG. 15, the head driving unit 80 includes a shift register 81, a latch 82, drive waveform generating units 83 (83-1 to 83-N), a fundamental drive waveform information holding unit 84, a drive waveform correction information holding unit 85, and a control unit 86.

From the controller 90 to the head driving unit 80, N number of sets of image data SD1 equivalent to a single row of the recording heads is serially input in synchronization with a transfer clock SCK. The N number of sets of serially-input image data are sequentially held in the shift register 81. Herein, for example, if it is assumed that the nozzles of the recording heads are configured to discharge ink droplets corresponding to dots of four different sizes such as large droplets, medium droplets, small droplets, and no discharge; then a single set of image data represents 2-bit data.

The latch 82 represents N number of latches for holding the N number of sets of image data, which are temporarily held in the shift register 81, in response to the input of a latch enable signal LEN; and each latch holds 2-bit data (from among the data D1 to the data DN) and supplies the data to the corresponding drive waveform generating unit 83.

The drive waveform generating units 83 generate drive waveforms meant for individually driving the N number of piezoelectric elements 5-1 to 5-N, and include N number of drive waveform generating units 83-1 to 83-N corresponding to the N number of piezoelectric elements 5-1 to 5-N. When the drive waveform generating unit 83-*i* representing the i-th channel (where i ranges from 1 to N) receives input of 2-bit image data Di from the latch 82 in synchronization with the latch enable signal LEN; the drive waveform generating unit 83-*i* refers to the fundamental drive waveform information held in the fundamental drive waveform information holding unit 84 and refers to the correction information held in the drive waveform correction information holding unit 85, and generates drive waveforms with the latch enable signal LEN serving as the start reference and supplies them to the piezoelectric element 5-*i*.

In the fundamental drive waveform information holding unit 84, fundamental drive waveform information, which represents the information of the fundament drive waveform not containing nozzle-by-nozzle (channel-by-channel) correction information, is held as the drive waveforms for each dot having a different size such as a large droplet, a medium droplet, a small droplet, and no discharge. From among the sets of fundamental drive waveform information held in the fundamental drive waveform information holding unit 84, the drive waveform generating unit 83-*i* obtains the fundamental drive waveform information corresponding to the image data Di supplied from the latch 82 (for example, if the image data Di indicates large droplets, fundamental drive waveform information for large droplets is obtained). The details regarding the fundamental drive waveform information are given later.

In the drive waveform correction information holding unit 85, correction information to be used in correcting the fundamental drive waveform information is held on a nozzle-by-nozzle basis (on a channel-by-channel basis). From among the sets of correction information held in the drive waveform correction information holding unit 85, the drive waveform generating unit 83-*i* obtains the correction information corresponding to the i-th channel. Then, the drive waveform generating unit 83-*i* corrects the fundamental drive waveform information, which is obtained from the fundamental drive waveform information holding unit 84, using the correction information, which is obtained from the drive waveform correction information holding unit 85; and generates the optimum drive waveforms for driving the i-th channel and supplies them to the piezoelectric element 5-*i*.

The control unit 86 controls the entire head driving unit 80. Moreover, the control unit 86 has the function of performing communication with the controller 90 and, for example, receives the fundamental drive waveform information and the correction information from the controller 90, and sets or updates the information in the fundamental drive waveform information holding unit 84 and the drive waveform correction information holding unit 85. The correction information that is held on a nozzle-by-nozzle basis is set by the controller 90 or the control unit 86 by appropriately calculating the drive waveform magnification correction value for every scanning count.

Given below is the explanation of the detailed configuration of the drive waveform generating units 83. As illustrated in FIG. 15, each drive waveform generating unit 83 (83-1 to 83-N) includes a charge-discharge signal generating unit 91 and a driver unit 92.

The charge-discharge signal generating unit 91 refers to the image data Di, the fundamental drive waveform information, the correction information, and the latch enable signal LEN representing the waveform generation start reference; and generates a charge signal "up" meant for controlling the timing and the period of time of charging the corresponding piezoelectric element 5, and generates a discharge signal "dn" meant for controlling the timing and the period of time of discharging the corresponding piezoelectric element 5.

The driver unit 92 charges the corresponding piezoelectric element 5 according to the charge signal "up" generated by the charge-discharge signal generating unit 91, and discharges the corresponding piezoelectric element 5 according to the discharge signal "dn" generated by the charge-discharge signal generating unit 91.

With such a configuration of the driver unit 92, the timing and the period of time of the active state of the charge signal "up" and the discharge signal "dn" can be controlled, and a voltage Vp (i.e., the drive waveforms) applied to the piezoelectric element 5 can be controlled to have an arbitrary waveform shape. Herein, since the drive waveform generating units 83 (83-1 to 83-N) are individually installed for the N number of piezoelectric elements 5-1 to 5-N, it becomes possible to drive each piezoelectric element 5 at the corresponding optimum drive waveforms. Thus, even if there occurs variation in the ink droplet quantity or in the points of impact either due to the variation in the nozzle shape or the ink flow path structure of each nozzle, or due to the variation in the piezoelectric element characteristics, or due to the variation in the switching element characteristics, or due to the variation in the temperature characteristics; the corresponding drive waveforms can be corrected to reduce such variation thereby enabling prevention of a decline in the image quality.

Meanwhile, of the head driving unit 80, only a driver unit 92 (a portion A enclosed in dashed lines in FIG. 15), which is the circuit that operates by getting connected to a power source (a voltage value Vh), is required to be configured with a high-voltage process; and the other components can be configured with a low-voltage process having the core voltage of 1 V, for example. Moreover, in a conventional drive waveform generation circuit, it is necessary to use a DA converter, a voltage amplifier, or a current amplifier for generating/driving the drive waveforms. Hence, even if the components are integrated, the size becomes extremely large. In contrast, in the second embodiment, the piezoelectric elements 5 can be driven using an extremely simple configuration as illustrated in FIG. 15. Hence, even if a plurality of drive waveform generating units 83 is disposed for each nozzle, it becomes possible to achieve an integrated circuit having a sufficiently small chip size for installation in the recording heads. In a conventional recording head too, at least one pair of bidirectional switching elements is disposed for each a piezoelectric element and, since the current flowing in the bidirectional switching elements is bidirectional, usually at least two or more transistors are disposed. Thus, even in a configuration having a plurality of drive waveform generating units 83 corresponding to each piezoelectric element 5 as explained in the second embodiment, the chip size does not increase as compared to the conventional recording head. Thus, the configuration does not lead to an increase in the device size, or an increase in the power consumption, or an increase in the cost.

The computer programs executed in the liquid discharging device according to the embodiments are recorded as installable files or executable files in a computer-recordable medium such as a compact disk read only memory (CD-ROM), a flexible disk (FD), a compact disk recordable (CD-R), or a digital versatile disk (DVD).

Alternatively, the computer programs executed in the liquid discharging device according to the embodiments can be stored in a downloadable manner in a computer connected to a network such as the Internet. Still alternatively, the computer programs executed in the liquid discharging device according to the embodiments can be distributed via a network such as the Internet.

Still alternatively, the computer programs executed in the liquid discharging device according to the embodiments can be stored in advance in a ROM.

Meanwhile, the liquid discharging device according to the embodiments can be implemented in a multifunction peripheral having at least two functions from, among the copying function, the printing function, the scanning function, and the facsimile function; or can be implemented in an image forming device such as a copying machine, a printer, or a facsimile machine.

According to the present embodiment, in a liquid discharging device, at the time of varying the drive waveforms according to the detected temperature, unevenness occurring in the density in a stepped manner can be reduced thereby enabling achieving enhancement in the image quality.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharging device comprising:

a recording head that has a plurality of nozzles for discharging liquid, and that forms an image on a discharge target surface by discharging liquid onto the discharge target surface while performing scanning of the discharging target surface for a plurality of times;

a moving unit that moves the recording head in main-scanning direction while making the recording head discharge liquid, and moves the recording head in sub-scanning direction after the recording head has discharged liquid;

a drive waveform applying unit that applies a drive waveform to each of the plurality of nozzles;

a temperature detecting unit that detects temperature in vicinity of the recording head;

a correcting unit that corrects drive waveform based on temperature detected by the temperature detecting unit; and a control unit that, when temperature in vicinity of the recording head changes from first temperature to second temperature, performs control in such a way that, during the scanning for a plurality of times, use of second-type drive waveform corresponding to the second temperature gradually increases against use of first-type drive waveform corresponding to the first temperature.

2. The liquid discharging device according to claim 1, wherein the control unit divides the discharge target surface into a plurality of scanning areas, further divides each of the plurality of scanning areas Into a plurality of cell areas, and performs control to vary drive waveform for the plurality of nozzles in such a way that, during the scanning for a plurality of times, number of cell areas to which liquid is discharged using the second-type drive waveform increases in a gradual manner.

3. The liquid discharging device according to claim 2, wherein the control unit decides on number of the plurality of scanning areas and decides on number of the plurality of cell areas based on resolution of the image and nozzle density of the recording head.

4. The liquid discharging device according to claim 1, wherein the control unit divides the liquid discharge surface into a plurality of scanning areas, and at time of scanning the plurality of scanning areas for a plurality of times, performs control to vary drive waveform for the plurality of nozzles in such a way that ratio of nozzles driven using the second-type drive waveform, from among all nozzles that are used, gradually increases in proportion to increase in scanning count.

5. A drive waveform control method comprising:

forming that includes using a recording head which has a plurality of nozzles for discharging liquid, and forming an image on a discharge target surface by discharging liquid onto the discharge target surface while performing scanning of the discharging target surface for a plurality of times;

moving that includes moving the recording head in main-scanning direction while making the recording head discharge liquid, and moving the recording head in sub-scanning direction after the recording head has discharged liquid;

applying a drive waveform to each of the plurality of nozzles;

detecting temperature in vicinity of the recording head;

correcting drive waveform based on the detected temperature; and controlling that, when temperature in vicinity of the recording head changes from first temperature to second temperature, includes performing control in such a way that during the scanning for a plurality of times, use of second-type drive waveform corresponding to the second temperature gradually increases against use of first-type drive waveform corresponding to the first temperature.

6. The drive waveform control method according to claim 5, wherein the controlling includes dividing the discharge target surface into a plurality of scanning areas, further dividing each of the plurality of scanning areas into a plurality of cell areas, and performing control to vary drive waveform for the plurality of nozzles in such a way that, during the scanning for a plurality of times, number of cell areas to which liquid is discharged using the second-type drive waveform increases in a gradual manner.

7. The drive waveform control method according to claim 6, wherein the controlling includes deciding on number of the plurality of scanning areas and deciding on number of the plurality of cell areas based on resolution of the image and nozzle density of the recording head.

8. The drive waveform control method according to claim 5, wherein the controlling includes dividing the liquid discharge surface into a plurality of scanning areas, and controlling that, at time of scanning the plurality of scanning areas for a plurality of times, includes performing control to vary drive waveform for the plurality of nozzles in such a way that ratio of nozzles driven using the second-type drive waveform, from among all nozzles that are used, gradually increases in proportion to increase in scanning count.

* * * * *